US005603363A

United States Patent [19]

Nelson

[11] Patent Number: 5,603,363

[45] Date of Patent: Feb. 18, 1997

[54] APPARATUS FOR DISPENSING A CARBONATED BEVERAGE WITH MINIMAL FOAMING

[75] Inventor: Patrick L. Nelson, Sun Prarie, Wis.

[73] Assignee: Exel Nelson Engineering LLC, Madison, Wis.

[21] Appl. No.: 492,880

[22] Filed: Jun. 20, 1995

[51] Int. Cl.[6] ..... B65B 1/04

[52] U.S. Cl. ..... 141/351; 141/94; 141/361; 222/504; 222/146.6

[58] Field of Search ..... 141/82, 94, 98, 141/102, 351, 360, 361, 362, 392; 222/504, 509, 146.6, 152

[56] References Cited

U.S. PATENT DOCUMENTS 2,912,143 11/1959 Woolfolk ..... 222/504
3,072,302 1/1963 Giovannoni et al. ..... 222/504
3,881,636 5/1975 D'Aubreby ..... 141/102
4,805,806 2/1989 Smith ..... 222/146.6

*Primary Examiner*—David J. Walczak
*Assistant Examiner*—Steven O. Douglas
*Attorney, Agent, or Firm*—Quarles & Brady

[57] ABSTRACT

Carbonated beverages are dispensed by an apparatus that includes a tank mounted for holding the beverage at atmospheric pressure. An inlet tube is provided to supply beverage beneath the surface of the beverage already in said tank. An nozzle projects from said tank for a length at least as great as the depth of a serving container into which beverage will be dispensed. A valve member movably located in an outlet of the nozzle and has a conical shape. The valve member is moved by an actuator between a closed position in which the outlet of the nozzle is sealed against beverage flow, and an open position in which beverage can flow from the nozzle. The conical shape of said valve member disperses the beverage in a 360 degree pattern around the outlet to reduce beverage foaming. A shell encloses the tank and forms a cavity therebetween through which chilled air circulates to maintain the beverage in the tank at a desired serving temperature.

20 Claims, 2 Drawing Sheets

APPARATUS FOR DISPENSING A CARBONATED BEVERAGE WITH MINIMAL FOAMING

BACKGROUND OF THE INVENTION

The present invention relates to dispensing equipment for filling an open container with a carbonated beverage; and more particularly to such an apparatus in which the dispensing occurs in a manner which minimizes foaming of the beverage.

It is common for carbonated beverages, such as soda and beer, to be supplied to a vendor in a sealed canister or keg which then is connected to a tap at the vendor's establishment. Pressurized gas, such as carbon dioxide, is injected into the beverage canister or keg to push the liquid beverage through an outlet tube to the tap where it is dispensed into various sizes of cups, mugs and pitchers. Carbonated soda is also supplied to vendors as a concentrate, or syrup, which is mixed at the tap with carbonated water from another source at the vendor's establishment.

Regardless of which type of dispensing method is utilized, the carbonated beverage usually foams while being dispensed into the serving container. As a consequence, personnel operating the dispenser must fill the serving container until the level of foam reaches the brim and then wait for the foam to settle before adding additional beverage. In some instances several iterations of this process must occur before the container is filled with liquid to the proper serving level. "Topping off" necessitated by the foaming of the beverage prolongs the dispensing operation and impedes the ability to fully automate the dispensing of carbonated beverages.

Nevertheless many establishments have push buttons activated taps which automatically dispense measured quantities of beverage into different sized serving containers, such as a glass, mug and a pitcher. However, the automated equipment can only partially fill the serving container and the user still must manually top-off the container after the foam from the automated step has settled in order to dispense the proper serving quantity.

Dispensing beverage from the canister or keg also is prone to a certain amount of shrinkage. For example, the amount of beverage which foams over the brim of the serving container during the dispensing operation is lost. In addition, quantities of the beverage may be dispensed into containers for which payment is not received, as occurs when the server hands out free drinks to friends. A significant percentage of the volume in the canister or keg may be lost due to shrinkage.

Automated dispensing is particularly useful in large volume carbonated beverage operations, such as at sports arenas and stadiums, where it is desirable to fill each container to the full serving level as fast as possible. Such large scale dispensing operations also must be performed with minimal shrinkage due to waste and pilferage.

SUMMARY OF THE INVENTION

A general object of the present invention is to provide an apparatus for dispensing carbonated beverages into a serving container in a manner which minimizes foaming of the beverage and permits rapid dispensing to occur. Thus such apparatus is particularly suited to high volume dispensing operations.

Another object of the present invention is to provide such an apparatus which minimizes shrinkage due to wasted beverage during the dispensing operation.

These an other objectives are fulfilled by a dispenser that has a tank with a chamber for holding the carbonated beverage to be dispensed at atmospheric pressure. An inlet allows additional beverage to be introduced beneath the surface of the beverage held in the tank so that air is not mixed with the incoming beverage. A nozzle projects from said tank to an outlet at one end through which the carbonated beverage held in the tank is dispensed into a serving container. Preferably the length of the nozzle is at least as great as the depth of the serving container so that most of the beverage will be dispensed into the serving container beneath the surface of previously dispensed beverage. This minimizes the amount of air which mixes which the beverage during the dispensing and thus minimizes foaming of the beverage.

A valve member has a first end which extends into the outlet of the nozzle and a larger end is outside the outlet. The valve member has a conically shaped member which not only aids in closing the nozzle outlet, but also disperses the beverage in a 360 degree pattern around the outlet. Such dispersal pattern further reduces foaming of the beverage being dispensed into a serving container. An actuator moves the valve member out of and into the outlet to permit and inhibit the flow of beverage from the nozzle.

Also described are mechanisms for sensing the level of beverage stored in the tank and automatically replenishing beverage which has been dispensed, and for circulating a chilled fluid around the tank to maintain the stored beverage at a desired serving temperature which also acts to reduce foaming. A system for cleaning the tank and nozzle after use of the beverage dispenser is included.

DETAILED DESCRIPTION OF THE INVENTION

Figure 1:
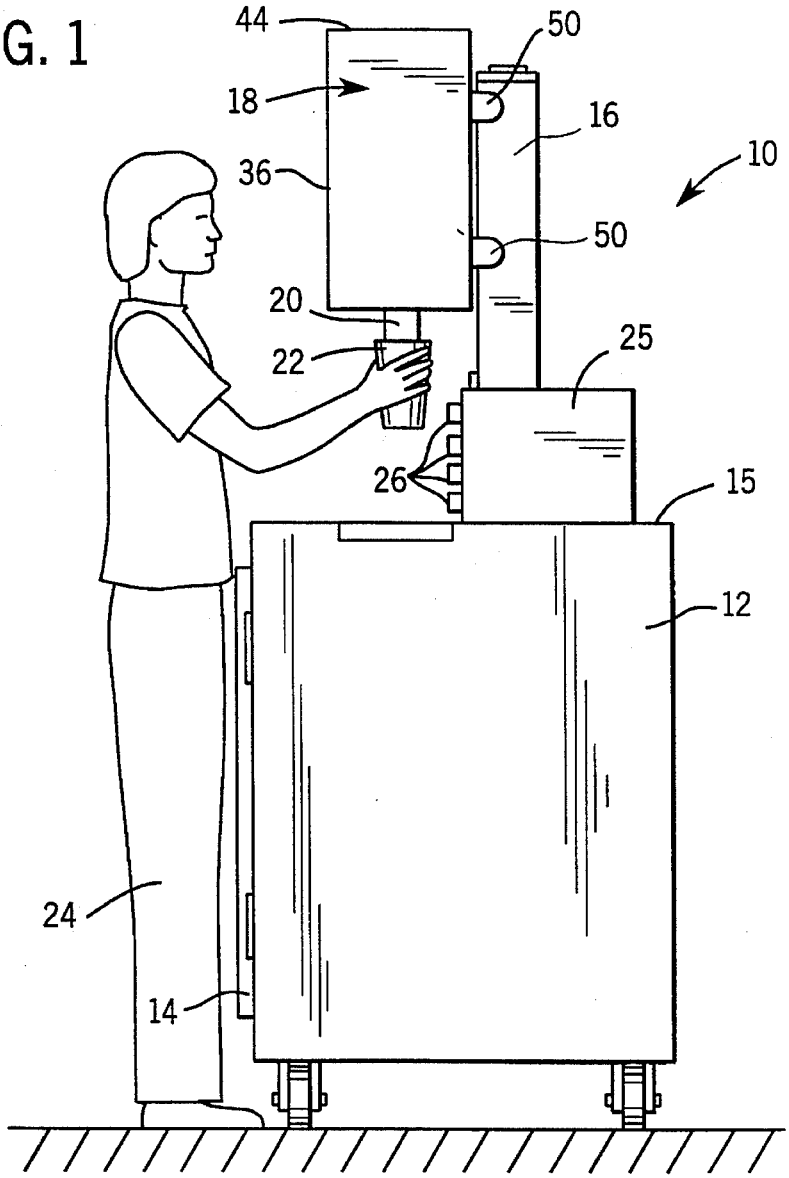
FIG. 1 is a side view of a carbonated beverage dispensing station according to the present invention.

FIG. 1 illustrates a carbonated beverage dispensing apparatus 10 of a type that is commonly used in fast-food establishments and sports venues. The apparatus 10 consists of a refrigeration unit 12 that forms a closed chamber within which kegs or canisters of the beverage to be dispensed are stored. The refrigeration unit 12 includes a conventional compressor operated refrigeration system which cools the chamber to a desired serving temperature for the beverage. In addition, the refrigeration unit 12 either contains a cylinder of carbon dioxide or fittings to attach to an external carbon dioxide source to supply gas which forces the carbonated beverage out of the canister or keg to a dispenser 18, as is common practice. The refrigeration unit 12 includes a door 14 for access to the chamber in order to insert and remove the canisters or kegs of carbonated beverage.

A hollow pillar 16 extends upward from the top surface 15 of the refrigeration unit 12 and has the dispenser 18 attached thereto. Extending downward from the dispenser 18 is the nozzle 20 through which the carbonated beverage is dispensed into a serving container 22, such as cup, held thereunder by a human server 24. The dispensing operation is controlled via a computer 25 connected to a plurality of push-button switches 26 by which the operator selects different functions to be performed, as will be described. For example, each push-button switch may be used to select specific quantities of carbonated beverage to be dispensed for filling different sized serving containers 22, such as a cup, a mug or a pitcher. The computer 25 may be a commercially available programmable logic controller (PLC) commonly used in commercial and industrial control applications.

Figure 2:
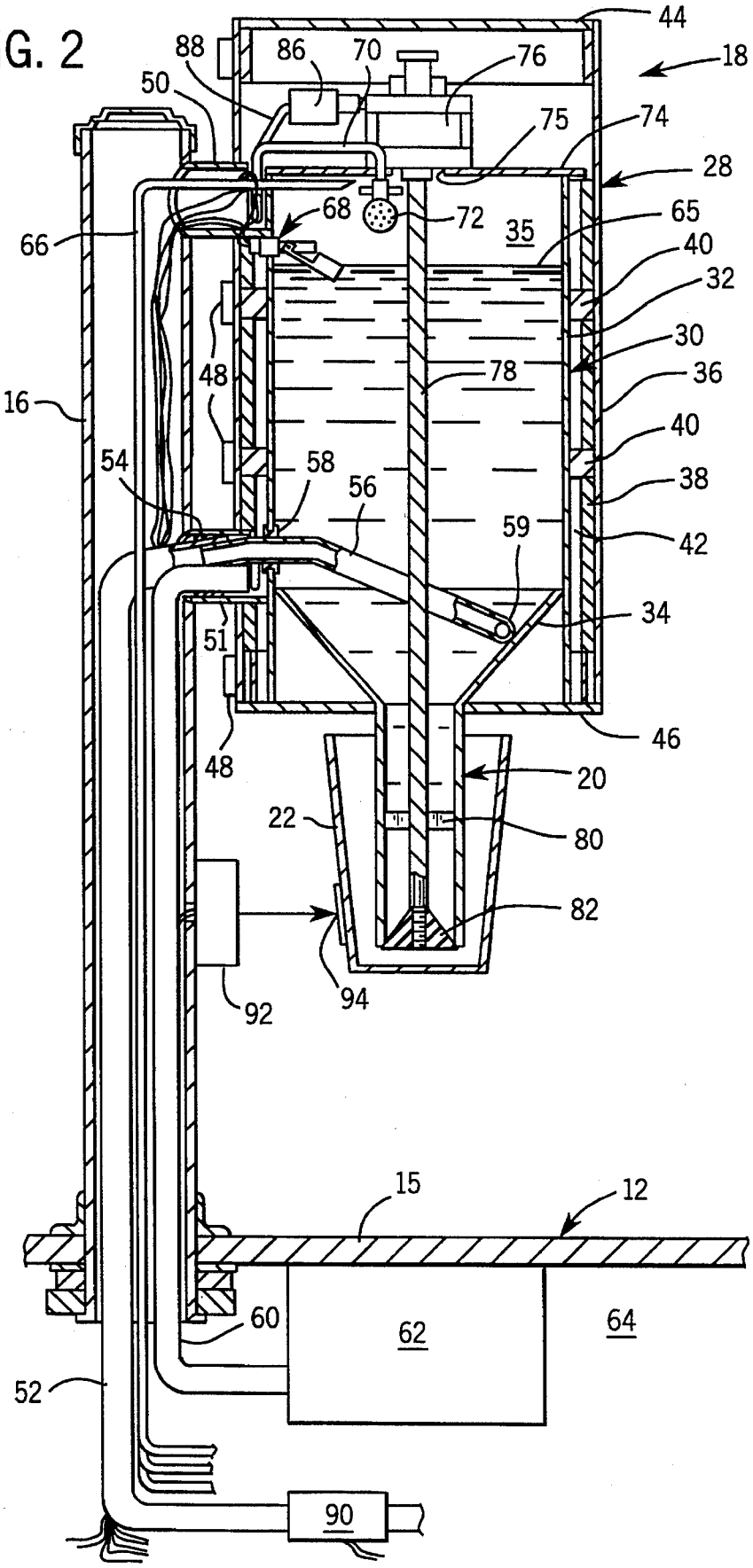
FIG. 2 is a cross section through the dispenser mechanism at the beverage dispensing station.

Referring to FIG. 2, the dispenser 18 has a cylindrical shape and comprises a housing 28 within which is contained a tank 30 made of stainless steel or other material approved for food handling. The tank 30 has a cylindrical upper section 32 with a conical bottom 34 that has the larger diameter end welded inside the upper tank section 32. The tubular nozzle 20 of stainless steel is welded to the smaller end of the conical tank bottom 34 and extends downward out of the housing 28. The housing 28 comprises a thin outer shell 36 with insulating material 38 adhesively applied to its inner surface. Additional insulation can be provided above and below the tank 30. The outer housing shell 36 is a sheet, of stainless steel for example, that is curved to wrap around the outside of the tank 30 with the abutting ends of the sheet being adjacent to pillar 16 and held together by a series of clamps 48. A number of spacers 40 are located between the tank 30 and the outer housing shell 36 to maintain the two components spaced apart forming a cavity 42 therebetween. The spacers either have holes therethrough or do not extend entirely around the tank 30 to permit vertical air flow in the cavity 42. The ends of the outer housing shell 36 are closed by top and bottom covers 44 and 46, respectively. The bottom cover 46 is welded to the bottom end of the tank 30. The upper housing cover 44 merely fits snugly into the upper end of the outer housing shell 36 held therein by friction so as to be removable for access to the tank. It should be noted that the upper housing cover 44 does not provide an airtight seal and thus the interior 35 of the tank 30 is at atmospheric pressure.

The tank 30 is structurally attached to pillar 16 by upper and lower support tubes 50 and 51 each having one end welded into openings in the pillar 16 and another end welded to the exterior surface of the tank. As shown in FIG. 2, the lower end of the hollow pillar 16 extends through a hole in the top surface 15 of the refrigeration unit 12 so that various tubes and wires can extend from the refrigeration unit to the dispenser 18, as will be described in detail. Alternatively, the dispenser 18 can be mounted on a counter top with supply tubes extending from beverage canisters or kegs stored in a separate refrigerator.

Flexible beverage supply tube 52 extends from the beverage canister or keg up through the pillar 16 and into the lower support tube 51. The upper end of the beverage supply tube 52 projects through a gasket seal 54 within the lower supply tube 51 and has a rigid tank supply tube 56 inserted therein. The tank supply tube 56 extends from the lower support tube 51 through an aperture in the tank 30 with a gasket 58 providing a fluid-tight seal between the tank and the supply tube 56. The tank supply tube 56 bends downward in the tank interior 35 and has an open end 59 within the conical bottom 34 of the tank. The open end 59 directs the carbonated beverage tangentially to the curved interior surface of conical bottom 34 to reduce turbulence of the beverage flowing into the tank.

A chilled air supply tube 60 has one end connected to the outlet of a blower 62 located within the chamber 64 of the refrigeration unit 12. The chilled air supply tube 60 extends upward through the pillar 16 terminating within the lower support tube 51 after passing through the gasket seal 54. As will be described in detail, cool air from the refrigeration unit chamber 64 is blown through the chilled air supply tube 60 into the cavity 42 between the tank 30 and the housing 28. The air circulates upward through that cavity 42 and exits via the upper support tube 50 flowing downward through the hollow pillar 16 back into the refrigeration unit chamber 64. This air circulation cools the tank 30 and the beverage contained therein.

A vent tube 66 extends from the upper region of the tank interior 35 through a sealed opening in the tank 30, the upper support tube 50 and pillar 16 to a floor drain which services the dispensing apparatus 10. The vent tube 66 provides an overflow passage should the beverage within the tank 30 approach the upper end. In addition, since the remote end the tube merely is placed adjacent to a floor drain rather than being sealed to a plumbing waste line, air is able to enter from the remote end and pass into the tank interior 35 thereby maintaining the interior at atmospheric pressure. Atmospheric air flows in and out of the tank interior 35 through the vent tube 66 as the level of beverage 65 within the tank 30 rises and falls.

A level sensor 68 is located near the top of the upper tank section 32 and comprises a conventional float actuated switch which closes when the level of beverage within the tank reaches a defined level. Other types of level sensors may be used in place of the float-type device shown. The level sensor 68 provides an electrical level signal to the computer 25, shown in FIG. 1. A cleaning tube 70 extends from a fitting located on refrigeration unit 12 upward through pillar 16 into the top of housing 28 and then downward into the tank 30. The end of the cleaning tube 70 within the tank interior 35 has a spray ball 72 attached thereto. The spray ball 72 is hollow with holes in its surface to spray fluid from the cleaning tube 70 in a 360 degree pattern within the tank. Periodically the tank 30 is drained of beverage and a soap solution and rinse water are sequentially sent through the cleaning tube 70 to wash the interior of tank 30.

Figure 3:
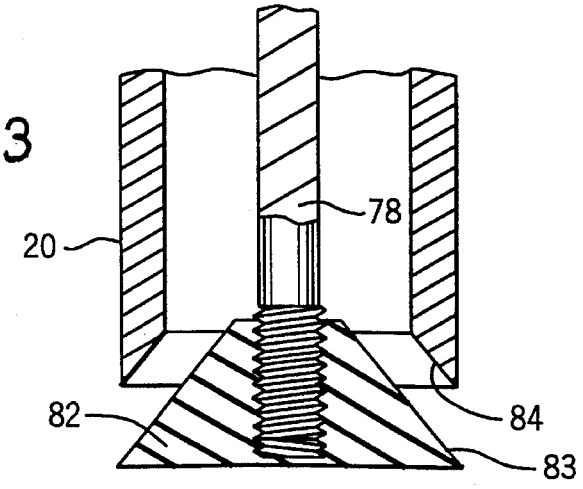
FIG. 3 is a cross section through an outlet of the dispenser mechanism showing the control valve in an open state.

The top of tank 30 has a plate 74 there across with a central opening 75. A pneumatic actuator 76 is mounted over the opening in the plate 74 and has an armature to which a valve rod 78 is attached. The valve rod 78 extends downward through the tank 30 and the nozzle 20 wherein a star-shaped pilot 80 spaces the valve rod centrally within the nozzle. The remote end of the valve rod 78 is threaded into an aperture within a rubber valve member 82. The valve member 82 has a conical shape with tapering sidewalls 83 that nests within a tapered outlet 84 in the lower end of the nozzle 20 (see FIG. 3). When the valve member 82 is retracted into the nozzle 20, the tapered walls of the valve member tightly engage the tapered nozzle outlet 84 to close the end of the nozzle preventing beverage from flowing therethrough from the tank 30. Alternately, when the pneumatic actuator 76 is energized to dispense beverage, the valve rod 78 and valve member 82 are extended downward as shown in FIG. 3 producing an opening at the end of nozzle 20.

The inlet to the pneumatic actuator 76 is connected to an electrically operated valve 86 which controls the flow of carbon dioxide to the actuator 76 from a supply line 88 connected to the cylinder that supplies carbon dioxide to the dispensing apparatus 10. Pressurized air also can be used to operate the pneumatic actuator 76. Alternatively, an electromagnetic solenoid actuator can be employed to operate the value rod 78.

In order to dispense a beverage from apparatus 10, a server 24 places the desired size serving container 22, such as a cup shown in FIG. 1, beneath the nozzle 20 and raises the cup upward so that the bottom of the nozzle is closely spaced from the bottom of the container. If the beverage is of the type that normally is served with ice, the ice is added to the cup after the beverage. The server presses one of the push-bottom switches 26 connected to computer 25 that corresponds to the size of the selected serving container 22. When beverage is being dispensed into containers of only one size, a foot switch may be provided for activation by the server. Alternatively, in this latter case, a sensor may detect the presence of a serving container under the nozzle and activate the dispensing. For example, an optical sensor 92 emits a light beam which is reflected by the nozzle 20 back to the sensor where a detector receives the light beam. The transmission of the light beam is broken by the presence of a serving container 22 which causes the optical sensor 92 to produce an electrical signal indicative of that presence.

Computer 25 responds to a signal from a push-button switch 26 or the optical sensor 92 by energizing the electrically operated valve 86 into an open state to supply pressurized gas to the pneumatic actuator 76. This action causes the actuator 76 to extend the valve rod 78 and the attached valve member 82 downward, opening the outlet 84 at the bottom of nozzle 20. This action causes beverage stored within tank 30 to flow downward through the nozzle 20 due to gravity and into the serving container 22. The tapered sidewalls 83 of the valve member 82 disperses the beverage evenly in a 360 degree distribution pattern around the valve member. This pattern minimizes the turbulence within the dispensed beverage and, thus minimizes foaming.

When beverage flows from the nozzle 20, the server 24 lowers the serving container 22 so that the volume of the nozzle 20 does not take up space in the container which should be filled with the beverage. This downward movement of the serving container 22 is controlled so that except for momentarily when the valve is first opened, the lower end of the nozzle 20 always will be below the level of beverage dispensed into the container. Thus, the beverage flowing from the nozzle opening is not mixed with air by turbulence at the nozzle outlet 84. It is such introduction of air into the beverage which produces foaming. Therefore by keeping the nozzle outlet 84 below the level of beverage within the serving container 22, the foaming is minimized.

Foaming of the beverage within the serving container also is reduced by the fact that the beverage dispensed through nozzle 20 is not pressurized as in conventional beverage taps. The force exerted on the dispensing beverage is only due to the height of the beverage within the tank 30 and not due to the pressure of the carbon dioxide that forces the beverage from the canister or keg within the refrigeration unit 12. By maintaining the beverage within the tank 30 at atmospheric pressure, turbulence at the nozzle outlet 84 is reduced and so too foaming of the carbonated beverage. The tank provides a sufficient height of beverage so that rapid dispensing occurs without pressurizing the beverage.

As the level of beverage within the tank 30 drops during the dispensing operation, the level sensor 68 provides a signal indicating such to the computer 25. In response, the computer 25 sends an electrical signal to an electrically operated valve 90 in the beverage supply tube 52. That electrical signal opens the electrically operated valve 90 causing beverage to flow from the canister or keg within refrigeration unit 12 through tubes 52 and 56, and into bottom of the tank 30. This replenishes the volume of beverage dispensed from tank. As the beverage 65 within the tank rises to the height of level sensor 68, the sensor switch opens signalling the computer 25 which responds by closing the beverage supply line valve 90.

Chilled beverage is less susceptible foaming than beverage which is at room temperature. In order to prevent the beverage stored within tank 30 from reaching room temperature, the blower 62 circulates the chilled air from within the refrigeration unit 12 through the air supply tube 60 into the cavity 42 between the tank 30 and the outer housing shell 36. The chilled air enters this cavity 42 through the lower support tube 51, circulates around the tank 30 and exits via the upper support tube 50 and the pillar 16, back into the chamber 64 of the refrigeration unit. This circulating chilled air from the refrigeration unit 12 maintains the beverage within tank 30 at the desired serving temperature which also reduces the foaming when the beverage is dispensed into a serving container 22.

The dispensing of beverage from the nozzle 20 continues for a given amount of time as determined by the computer 25 for the selected size of container 22. The flow rate of beverage out of nozzle 20 is relatively constant with insignificant variation occurring as the height of the beverage within the tank 30 drops during the dispensing operation. Because the flow rate of dispensing beverage is relatively constant, the computer 25 holds the valve member 82 in an open state for a predefined amount of time that corresponds to the size of the container 22 that has been selected. Thus, the computer 25 responds to the server 24 pressing different push-button switches 26, which correspond to specific size serving containers, by opening the nozzle 20 for different amounts of time that correspond to the selected container size. When the corresponding dispensing time has elapsed, the computer 25 de-energizes electrically operated valve 86 on the gas supply line 88 which deactivates the pneumatic actuator 76. A spring within the pneumatic actuator causes valve rod 78 and valve member 82 to be retracted upward into the nozzle 20 closing the outlet 84 and terminating the flow of beverage.

After each dispensing operation, the computer 25 updates data stored within its memory. For example, the quantity of beverage poured into the serving container 22 can be added to a previous value stored within the computer memory in order to tabulate the total amount of beverage that has been dispensed. By knowing this total amount and the volume of a full canister or keg of beverage, the computer is able to calculate the quantity of beverage remaining in the canister or keg. When the supply of beverage is nearing exhaustion, a warning light (not shown) on the front of the computer 25 can be illuminated to alert the server 24 to that fact so that the canister or keg can be replaced. The computer 25 also counts the number of each different sizes of serving containers that are dispensed so as to track the inventory of serving containers and provide management information.

In a large sports venue where there will be numerous dispensing apparatus 10, each computer 25 can be connected via a telephone line or a communication network to a central computer which monitors the operation of all of the dispensing apparatus and provides cumulative sales information for the entire facility.

The count of the different size containers and the total quantity of beverage dispensed can be reconciled to determine the amount of waste at the dispensing apparatus 10. Because the amount of foaming during the dispensing operation is kept to a minimum, the amount of waste is reduced as compared with conventional dispensing apparatus. As a consequence, the reconciliation of data is useful in determining whether a specific server is inefficient or may be dispensing beverages without receiving payment, or not depositing payment in the till.

We claim:

1. A carbonated beverage dispenser comprising:

a tank which has a chamber for holding a carbonated beverage to be dispensed wherein the chamber is maintained at atmospheric pressure;

an inlet through which the carbonated beverage is introduced into said tank;

a nozzle projecting from said tank, and having an outlet through which the carbonated beverage held in the tank is dispensed;

a conical member having a first end extending into the outlet of said nozzle and having a larger end outside the outlet nozzle, wherein the shape of said conical member in association with said nozzle disperses the carbonated beverage in a 360 degree pattern around the outlet; and a mechanism which selectively permits and inhibits flow of beverage through said nozzle from said tank.

2. The carbonated beverage dispenser as recited in claim 1 wherein said nozzle has a length which is substantially at least as great as a depth of a container into which beverage is to be dispensed.

3. The carbonated beverage dispenser as recited in claim 1 further comprising a shell around and spaced from said tank; and a cooling mechanism that circulates a chilled fluid in a space between said shell and said tank.

4. The carbonated beverage dispenser as recited in claim 1 wherein said tank has a conical shaped bottom in which a cross-sectional area decreases to an end from which said nozzle extends.

5. The carbonated beverage dispenser as recited in claim 1 wherein said mechanism comprises a pneumatically powered actuator connected to move said conical member into and out of the outlet to close and open, respectively, said nozzle.

6. The carbonated beverage dispenser as recited in claim 1 further comprising a sensor for detecting a level of beverage in said tank.

7. The carbonated beverage dispenser as recited in claim 6 further comprising a valve for controlling a flow of beverage through the inlet in response to said sensor.

8. The carbonated beverage dispenser as recited in claim 1 further comprising a vent tube extending into an upper portion of said tank to provide a passageway for atmospheric air to enter said tank and for excess beverage to drain from said tank.

9. The carbonated beverage dispenser as recited in claim 1 further comprising a spray head within said tank for spraying a fluid to cleanse the chamber of said tank.

10. A carbonated beverage dispenser comprising:

a tank which has a chamber for holding a carbonated beverage to be dispensed with the chamber being maintained at atmospheric pressure;

an inlet through which the carbonated beverage is introduced into said tank;

an nozzle projecting from said tank, and having an outlet through which the carbonated beverage held in the tank is dispensed;

a valve member movably located in the outlet of said nozzle and having a conical shape which a side wall which tapers from a first end to a second end that is larger than the first end, said valve member having a closed position in which the side wall extends into and closes the outlet of said nozzle to beverage flow, and having an open position in which the side wall is spaced from the nozzle to permit beverage flow therebetween wherein the conical shape of said valve member disperses the carbonated beverage at the outlet; and an actuator connected to said valve member to move said valve member between the closed position and the open position.

11. The carbonated beverage dispenser as recited in claim 10 wherein said nozzle has a length which is substantially at least as great as a depth of a container into which the carbonated beverage is to be dispensed.

12. The carbonated beverage dispenser as recited in claim 10 wherein said actuator is located above said tank; and further comprising a rod extending through said tank connecting said actuator to said valve member.

13. The carbonated beverage dispenser as recited in claim 10 further comprising a controller which energizes said actuator to place said valve member into the open position for a predefined period of time.

14. A carbonated beverage dispenser comprising:

a hollow pillar for attaching to a support surface for the carbonated beverage dispenser;

a tank mounted on said hollow pillar and having a chamber for holding a carbonated beverage to be dispensed wherein the chamber is maintained at atmospheric pressure;

an inlet tube through which the carbonated beverage is introduced beneath a surface of carbonated beverage in said tank;

an nozzle projecting from said tank, and having an outlet through which the carbonated beverage held in the tank is dispensed;

a valve member movably located in the outlet of said nozzle and having a conical shape which a side wall which tapers from a first end to a second end that is larger than the first end, said valve member having a closed position in which the side wall extends into and closes the outlet of said nozzle to beverage flow, and having an open position in which the side wall is spaced from the nozzle to permit beverage flow therebetween wherein the conical shape of said valve member disperses the carbonated beverage at the outlet;

an actuator located above said tank connected to said valve member to move said valve member between the closed position and the open position; and a shell enclosing said tank and forming a cavity therebetween.

15. The carbonated beverage dispenser as recited in claim 14 wherein said nozzle has a length which is substantially at least as great as a depth of a container into which the carbonated beverage is to be dispensed.

16. The carbonated beverage dispenser as recited in claim 14 further comprising an upper mounting tube and a lower mounting tube both extending between said hollow pillar and said tank and forming passages between the cavity and an interior of said hollow pillar.

17. The carbonated beverage dispenser as recited in claim 14 further comprising a refrigeration unit for cooling a supply vessel for the carbonated beverage; and system which circulates chilled air from the refrigeration unit through the pillar and one of the upper and lower mounting tubes into the cavity between said tank and said shell.

18. The carbonated beverage dispenser as recited in claim 17 further comprising a passageway for the air to travel from the cavity through another one of the upper and lower mounting tubes and through said pillar to the refrigeration unit.

19. The carbonated beverage dispenser as recited in claim 14 further comprising a controller which energizes said actuator to place said valve member into the open position for a predefined period of time.

20. The carbonated beverage dispenser as recited in claim 14 further comprising a system which controls a flow of carbonated beverage into said tank through said inlet tube in response to sensing a level of carbonated beverage within the tank.

* * * * *